US008955268B2

(12) United States Patent
Jenkins et al.

(10) Patent No.: US 8,955,268 B2
(45) **Date of Patent: *Feb. 17, 2015**

(54) MODULAR TILE WITH CONTROLLED DEFLECTION

(71) Applicant: Connor Sport Court International, LLC, Salt Lake City, UT (US)

(72) Inventors: Mark L. Jenkins, Salt Lake City, UT (US); Jeremiah Shapiro, West Valley City, UT (US); Cheryl Forster, Salt Lake City, UT (US); Vaughn W. North, Salt Lake City, UT (US); David L. Stott, Providence, UT (US)

(73) Assignee: Connor Sport Court International, LLC, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/090,845

(22) Filed: Nov. 26, 2013

(65) Prior Publication Data

US 2014/0215950 A1 Aug. 7, 2014

Related U.S. Application Data

(63) Continuation of application No. 12/789,161, filed on May 27, 2010, now Pat. No. 8,596,023, which is a continuation of application No. 11/065,192, filed on Feb. 24, 2005, now Pat. No. 7,748,177.

(60) Provisional application No. 60/547,489, filed on Feb. 25, 2004.

(51) Int. Cl.
*E04F 11/16* (2006.01)
*E04F 15/22* (2006.01)

(Continued)

(52) U.S. Cl.
CPC ..... *E04F 15/225* (2013.01); *E01C 5/20* (2013.01); *E01C 13/045* (2013.01); *E04B 5/43* (2013.01)
USPC ..... 52/177; 52/747.11; 52/592.1; 52/392; 52/387; 15/215

(58) Field of Classification Search
USPC ..... 52/177, 506.01, 592.1, 391, 386, 387; 404/35, 41, 47; 15/215
See application file for complete search history.

(56) References Cited

U.S. PATENT DOCUMENTS 69,297 A 9/1867 Stafford
321,403 A 6/1885 Underwood (Continued)

FOREIGN PATENT DOCUMENTS

CN 2221623 3/1996
EP 0044371 1/1982

(Continued)

OTHER PUBLICATIONS www.invisiblestructures.com website Jul. 26, 2006, 109 pages.

(Continued)

*Primary Examiner* — Chi Q Nguyen
(74) *Attorney, Agent, or Firm* — Thorpe North & Western LLP

(57) ABSTRACT

A modular tile configured to interlock with multiple tiles to form a modular floor covering over a floor. The tile includes a top surface having a periphery defining side walls extending downward from the top surface, the side walls having a coupling portion configured to couple with other tiles adjacent thereto to form the modular floor covering. The tile also includes a bottom side, opposite the top surface, having a support grid including an array of downward extending polymeric post structures, at least some of the post structures including at least one resilient end portion configured to be positioned against the floor to facilitate controlled deflection of the post structures. The post structures may comprise primary and secondary post structures, with the secondary post structures limiting the deflection of the primary post structures.

20 Claims, 10 Drawing Sheets

(51) Int. Cl.

| | |
|---|---|
| ***E01C 5/20*** | (2006.01) |
| ***E01C 13/04*** | (2006.01) |
| ***E04B 5/43*** | (2006.01) |

(56) References Cited

U.S. PATENT DOCUMENTS

| | | | |
|---|---|---|---|
| 658,868 | A | 10/1900 | Rosenbaum |
| 1,177,231 | A | 3/1916 | Carter |
| 1,195,289 | A | 8/1916 | Stevens |
| 1,425,324 | A | 8/1922 | Kennedy |
| 1,472,956 | A | 11/1923 | Biegler |
| 1,824,571 | A | 9/1931 | Richardson |
| 1,896,957 | A | 2/1933 | Hutcheson |
| 1,971,320 | A | 8/1934 | Cederquist |
| 2,082,563 | A | 6/1937 | Bauer |
| 2,225,828 | A | 12/1940 | Godschall |
| 2,653,525 | A | 9/1953 | Sargeant |
| 2,680,698 | A | 6/1954 | Schnee |
| 2,735,166 | A | 2/1956 | Hoseason |
| 2,810,672 | A | 10/1957 | Taylor |
| 3,015,136 | A | 1/1962 | Doe |
| 3,122,073 | A | 2/1964 | Masse |
| 3,222,834 | A | 12/1965 | Taft |
| 3,251,076 | A | 5/1966 | Burke |
| 3,310,906 | A | 3/1967 | Glukes |
| 3,318,476 | A | 5/1967 | Clark |
| 3,332,192 | A | 7/1967 | Kessler et al. |
| 3,350,013 | A | 10/1967 | Bergquist |
| 3,425,624 | A | 2/1969 | Jacobs |
| 3,428,920 | A | 2/1969 | Oleksiak |
| 3,438,312 | A | 4/1969 | Becker et al. |
| 3,439,312 | A | 4/1969 | Greasley |
| 3,500,606 | A | 3/1970 | Wharmby |
| 3,511,001 | A | 5/1970 | Morgan |
| 3,531,902 | A | 10/1970 | Costa |
| 3,565,276 | A | 2/1971 | O'Brien |
| 3,611,609 | A | 10/1971 | Reijnhard |
| 3,614,915 | A | 10/1971 | Perry |
| 3,717,247 | A | 2/1973 | Moore |
| 3,723,233 | A | 3/1973 | Bourke |
| 3,735,988 | A | 5/1973 | Palmer et al. |
| 3,736,713 | A | 6/1973 | Flachbarth et al. |
| 3,775,918 | A | 12/1973 | Johnson |
| 3,795,180 | A | 3/1974 | Larsen |
| 3,802,144 | A | 4/1974 | Spica |
| 3,820,912 | A | 6/1974 | Hughes |
| 3,823,521 | A | 7/1974 | Heitholt et al. |
| 3,836,075 | A | 9/1974 | Botbol |
| 3,844,440 | A | 10/1974 | Hadfield et al. |
| 3,909,996 | A | 10/1975 | Ettlinger, Jr. et al. |
| 3,911,635 | A | 10/1975 | Traupe |
| 3,922,409 | A | 11/1975 | Stark |
| 3,925,946 | A | 12/1975 | Balinski et al. |
| 3,937,861 | A | 2/1976 | Zuckerman et al. |
| 3,946,529 | A | 3/1976 | Chevaux |
| 3,955,836 | A | 5/1976 | Traupe |
| 4,008,352 | A | 2/1977 | Dawes et al. |
| 4,008,548 | A | 2/1977 | Leclerc |
| 4,018,025 | A | 4/1977 | Collette |
| 4,054,987 | A | 10/1977 | Forlenza |
| 4,118,892 | A | 10/1978 | Nakamura et al. |
| 4,133,481 | A | 1/1979 | Bennett |
| 4,167,599 | A | 9/1979 | Nissinen |
| 4,201,965 | A | 5/1980 | Onyshkevych |
| D255,744 | S | 7/1980 | Dekko |
| 4,226,060 | A | 10/1980 | Sato |
| 4,226,064 | A | 10/1980 | Kraayenhof |
| 4,244,484 | A | 1/1981 | Guritz et al. |
| 4,274,626 | A | 6/1981 | Grosser et al. |
| 4,285,518 | A | 8/1981 | Pearo |
| 4,287,693 | A | 9/1981 | Collette |
| 4,338,758 | A | 7/1982 | Hagbjer |
| 4,361,614 | A | 11/1982 | Moffitt, Jr. |
| 4,386,138 | A | 5/1983 | Arbit |
| 4,419,382 | A | 12/1983 | Sliemens et al. |
| 4,424,968 | A | 1/1984 | Smith |
| 4,430,837 | A | 2/1984 | Kirschenbaum |
| 4,436,779 | A | 3/1984 | Menconi et al. |
| 4,440,818 | A | 4/1984 | Buchan et al. |
| D274,588 | S | 7/1984 | Swanson et al. |
| D274,948 | S | 7/1984 | Swanson et al. |
| 4,468,910 | A | 9/1984 | Morrison |
| 4,478,901 | A | 10/1984 | Dickens et al. |
| 4,478,905 | A | 10/1984 | Neeley, Jr. |
| 4,497,858 | A | 2/1985 | Dupont et al. |
| 4,509,930 | A | 4/1985 | Schweigert et al. |
| 4,526,347 | A | 7/1985 | McLoughlin |
| 4,541,132 | A | 9/1985 | Long |
| 4,559,250 | A | 12/1985 | Paige |
| 4,577,448 | A | 3/1986 | Howorth |
| 4,584,221 | A | 4/1986 | Kung |
| 4,590,731 | A | 5/1986 | DeGooyer |
| 4,596,729 | A | 6/1986 | Morrison |
| 4,596,731 | A | 6/1986 | Cudmore et al. |
| D286,575 | S | 11/1986 | Saunders |
| 4,640,075 | A | 2/1987 | Nuncio |
| 4,648,592 | A | 3/1987 | Harinishi |
| 4,650,180 | A | 3/1987 | Blondel |
| 4,650,188 | A | 3/1987 | Schroeder |
| 4,681,482 | A | 7/1987 | Arciszewski et al. |
| 4,681,786 | A | 7/1987 | Brown |
| 4,694,627 | A | 9/1987 | Omholt |
| 4,702,048 | A | 10/1987 | Millman |
| 4,715,743 | A | 12/1987 | Schmanski |
| 4,727,697 | A | 3/1988 | Vaux |
| 4,728,468 | A | 3/1988 | Duke |
| 4,749,302 | A | 6/1988 | DeClute |
| 4,766,020 | A | 8/1988 | Ellingson, Jr. |
| 4,807,412 | A | 2/1989 | Frederiksen |
| 4,819,932 | A | 4/1989 | Trotter, Jr. |
| 4,826,351 | A | 5/1989 | Haberhauer et al. |
| 4,849,267 | A | 7/1989 | Ward et al. |
| 4,860,510 | A | 8/1989 | Kotler |
| 4,875,800 | A | 10/1989 | Hicks |
| 4,877,672 | A | 10/1989 | Shreiner |
| 4,917,532 | A | 4/1990 | Haberhauer et al. |
| 4,930,286 | A | 6/1990 | Kotler |
| 4,948,116 | A | 8/1990 | Vaux |
| 4,963,054 | A | 10/1990 | Hayashi |
| 4,964,751 | A | 10/1990 | Rope et al. |
| 4,973,505 | A | 11/1990 | Bielous |
| 5,022,200 | A | 6/1991 | Wilson et al. |
| 5,039,365 | A | 8/1991 | Rutledge, Sr. et al. |
| 5,048,448 | A | 9/1991 | Yoder |
| 5,052,158 | A | 10/1991 | D'Luzansky |
| 5,111,630 | A | 5/1992 | Munsey et al. |
| D327,748 | S | 7/1992 | Dorfman, Jr. |
| 5,143,757 | A | 9/1992 | Skinner |
| 5,157,804 | A | 10/1992 | Williams |
| 5,160,215 | A | 11/1992 | Jensen |
| 5,185,193 | A | 2/1993 | Phenicie et al. |
| 5,190,799 | A | 3/1993 | Ellingson, III |
| 5,195,288 | A | 3/1993 | Penczak |
| 5,205,091 | A | 4/1993 | Brown |
| 5,205,092 | A | 4/1993 | Taylor |
| 5,215,802 | A | 6/1993 | Kaars Sijpstein |
| 5,228,253 | A | 7/1993 | Wattelez |
| 5,229,437 | A | 7/1993 | Knight |
| 5,234,738 | A | 8/1993 | Wolf |
| 5,250,340 | A | 10/1993 | Bohnhoff |
| 5,253,464 | A | 10/1993 | Nilsen |
| 5,295,341 | A | 3/1994 | Kajiwara |
| 5,303,669 | A | 4/1994 | Szekely |
| 5,323,575 | A | 6/1994 | Yeh |
| 5,333,423 | A | 8/1994 | Propst |
| 5,342,141 | A | 8/1994 | Close |
| 5,364,204 | A | 11/1994 | MacLeod |
| 5,365,710 | A | 11/1994 | Randjelovic |
| 5,377,471 | A | 1/1995 | Niese |
| 5,379,557 | A | 1/1995 | Kotter |
| 5,412,917 | A | 5/1995 | Shelton |
| 5,414,324 | A | 5/1995 | Roth et al. |
| 5,418,036 | A | 5/1995 | Tokikawa et al. |
| 5,449,246 | A | 9/1995 | Housley |

(56) References Cited

U.S. PATENT DOCUMENTS 5,456,972 A 10/1995 Roth et al.
5,462,771 A 10/1995 Motoki et al.
5,466,424 A 11/1995 Kusano et al.
5,466,489 A 11/1995 Stahl
5,502,148 A 3/1996 Hentschel et al.
5,509,244 A 4/1996 Bentzon
5,511,353 A 4/1996 Jones
5,518,799 A 5/1996 Finestone et al.
5,526,619 A 6/1996 Vagedes
5,527,128 A 6/1996 Rope et al.
5,542,221 A 8/1996 Streit et al.
5,567,490 A 10/1996 Papazian et al.
5,573,715 A 11/1996 Adams et al.
D377,398 S 1/1997 Adam
5,609,000 A 3/1997 Niese
5,616,389 A 4/1997 Blatz
5,628,160 A 5/1997 Kung
5,634,309 A 6/1997 Polen
5,640,821 A 6/1997 Koch
5,642,592 A 7/1997 Andres
5,647,184 A 7/1997 Davis
5,679,385 A 10/1997 Adams et al.
5,682,724 A 11/1997 Randjelovic
5,693,390 A 12/1997 Inagaki et al.
5,693,395 A 12/1997 Wine
5,695,064 A 12/1997 Huang et al.
5,713,175 A 2/1998 Mitchell
5,713,806 A 2/1998 Teitgen et al.
5,735,096 A 4/1998 Krass
5,749,787 A 5/1998 Jank
5,758,467 A 6/1998 Snear et al.
5,761,867 A 6/1998 Carling
5,787,654 A 8/1998 Drost
5,803,973 A 9/1998 Szczgrybrowski et al.
5,815,995 A 10/1998 Adam
5,816,010 A 10/1998 Conn
5,816,738 A 10/1998 Harnapp
5,819,491 A 10/1998 Davis
5,820,294 A 10/1998 Baranowski
5,822,828 A 10/1998 Berard et al.
5,833,386 A 11/1998 Rosan et al.
5,848,856 A 12/1998 Bohnhoff
5,865,007 A 2/1999 Bowman et al.
5,899,038 A 5/1999 Stroppiana
5,904,021 A 5/1999 Fisher
5,906,082 A 5/1999 Counihan
5,906,454 A 5/1999 Medico, Jr. et al.
5,907,934 A 6/1999 Austin
5,910,401 A 6/1999 Anderson et al.
5,937,602 A 8/1999 Jalbert
5,950,378 A 9/1999 Council et al.
D415,581 S 10/1999 Bertolini
5,992,106 A 11/1999 Carling et al.
6,017,577 A 1/2000 Hostettler et al.
6,032,428 A 3/2000 Rosan et al.
6,044,598 A 4/2000 Elsasser et al.
6,047,663 A 4/2000 Moreau et al.
6,068,908 A 5/2000 Kessler et al.
6,095,718 A 8/2000 Bohnhoff
6,098,354 A 8/2000 Skandis
6,101,778 A 8/2000 Martensson
6,112,479 A 9/2000 Andres
6,128,881 A 10/2000 Bue et al.
6,134,854 A 10/2000 Stanchfield
D435,122 S 12/2000 Ross et al.
6,171,015 B1 1/2001 Barth et al.
D437,427 S 2/2001 Shaffer
6,189,289 B1 2/2001 Quaglia et al.
6,228,433 B1 5/2001 Witt
6,230,460 B1 5/2001 Huyett
6,231,939 B1 5/2001 Shaw et al.
6,286,272 B1 9/2001 Sandoz
6,301,842 B1 10/2001 Chaney et al.
6,302,803 B1 10/2001 Barlow
6,321,499 B1 11/2001 Chuang
6,324,796 B1 12/2001 Heath
6,345,483 B1 2/2002 Clark
6,355,323 B1 3/2002 Iwen et al.
D456,533 S 4/2002 Moller, Jr.
6,418,683 B1 7/2002 Martensson et al.
6,418,691 B1 7/2002 Stroppiana
6,428,870 B1 8/2002 Bohnhoff
6,436,159 B1 8/2002 Safta et al.
6,444,284 B1 9/2002 Kessler et al.
6,451,400 B1 9/2002 Brock et al.
6,453,632 B1 9/2002 Huang
6,467,224 B1 10/2002 Bertolini
6,526,705 B1 3/2003 MacDonald
6,531,203 B2 3/2003 Kessler et al.
6,543,196 B1 4/2003 Gonzales
6,562,414 B2 5/2003 Carling
6,578,324 B2 6/2003 Kessler et al.
6,585,449 B2 7/2003 Chen
6,588,166 B2 7/2003 Martensson et al.
6,605,333 B2 8/2003 Ferreira et al.
6,606,834 B2 8/2003 Martensson et al.
6,617,009 B1 9/2003 Chen et al.
D481,138 S 10/2003 Forster et al.
D481,470 S 10/2003 Moller, Jr.
6,637,163 B2 10/2003 Thibault et al.
6,640,513 B2 11/2003 Ku
6,669,572 B1 12/2003 Barlow
6,672,970 B2 1/2004 Barlow
6,672,971 B2 1/2004 Barlow
6,682,254 B1 1/2004 Olofsson et al.
D486,592 S 2/2004 Hong
6,684,582 B2 2/2004 Peart et al.
6,684,592 B2 2/2004 Martin
6,695,527 B2 2/2004 Seaux et al.
6,718,714 B1 4/2004 Montgomery, Sr.
6,718,715 B2 4/2004 Elliott
6,736,569 B2 5/2004 Lee
6,739,797 B1 5/2004 Schneider
D492,426 S 6/2004 Strickler
6,751,912 B2 6/2004 Stegner et al.
6,769,219 B2 8/2004 Schwitte et al.
6,793,586 B2 9/2004 Barlow et al.
6,802,159 B1 10/2004 Kotler
6,820,386 B2 11/2004 Kappeli et al.
6,833,038 B2 12/2004 Iwen et al.
6,851,236 B1 2/2005 Harvey
6,878,430 B2 4/2005 Milewski et al.
6,880,307 B2 4/2005 Schwitte et al.
6,895,881 B1 5/2005 Whitaker
6,902,491 B2 6/2005 Barlow et al.
6,931,808 B2 8/2005 Hamar
6,962,463 B2 11/2005 Chen
7,021,012 B2 4/2006 Zeng et al.
7,029,744 B2 4/2006 Horstman et al.
D522,149 S 5/2006 Shin
7,047,697 B1 5/2006 Heath
7,065,935 B2 6/2006 Ralf
7,090,430 B1 8/2006 Fletcher et al.
7,093,395 B2 8/2006 Hinault et al.
7,096,632 B2 8/2006 Pacione
7,114,298 B2 10/2006 Kotler
7,121,052 B2 10/2006 Niese et al.
7,127,857 B2 10/2006 Randjelovic
D532,530 S 11/2006 Shuman et al.
7,131,788 B2 11/2006 Ianniello et al.
7,144,609 B2 12/2006 Reddick
7,155,796 B2 1/2007 Cook
7,211,314 B2 5/2007 Nevison
7,299,592 B2 11/2007 Moller, Jr.
7,303,800 B2 12/2007 Rogers
7,340,865 B2 3/2008 Vanderhoef
7,383,663 B2 6/2008 Pacione
7,386,963 B2 6/2008 Pervan
7,412,806 B2 8/2008 Pacione et al.
7,464,510 B2 12/2008 Scott et al.
7,516,587 B2 4/2009 Barlow
7,520,948 B2 4/2009 Tavy et al.
D593,220 S 5/2009 Reed
7,527,451 B2 5/2009 Slater et al.

(56) References Cited

U.S. PATENT DOCUMENTS

| | | | | |
|---|---|---|---|---|
| 7,531,055 | B2 | 5/2009 | Mead | |
| 7,543,418 | B2 | 6/2009 | Weitzer | |
| 7,563,052 | B2 | 7/2009 | Van Reijen | |
| 7,571,572 | B2 | 8/2009 | Moller, Jr. | |
| 7,571,573 | B2 | 8/2009 | Moller, Jr. | |
| 7,587,865 | B2 | 9/2009 | Moller, Jr. | |
| RE41,140 | E | 2/2010 | Heath | |
| D611,626 | S | 3/2010 | Arden | |
| 7,676,291 | B2 | 3/2010 | Sheffield et al. | |
| 7,704,011 | B2 | 4/2010 | Marshall | |
| D618,368 | S | 6/2010 | Jenkins et al. | |
| 7,748,176 | B2 | 7/2010 | Harding et al. | |
| 7,748,177 | B2 * | 7/2010 | Jenkins et al. | 52/177 |
| 7,793,471 | B2 | 9/2010 | Hill | |
| 7,849,642 | B2 | 12/2010 | Forster et al. | |
| 7,849,658 | B2 | 12/2010 | Platts | |
| 7,900,416 | B1 | 3/2011 | Yokubison et al. | |
| 7,950,191 | B2 | 5/2011 | Brouwers | |
| 7,955,025 | B2 | 6/2011 | Murphy et al. | |
| 7,958,681 | B2 | 6/2011 | Moller, Jr. | |
| 8,006,443 | B2 | 8/2011 | Fuccella et al. | |
| 8,099,915 | B2 | 1/2012 | Moller, Jr. et al. | |
| 8,104,244 | B2 | 1/2012 | Pervan | |
| 8,122,670 | B2 | 2/2012 | Matthee | |
| D656,250 | S | 3/2012 | Forster et al. | |
| 8,225,566 | B2 | 7/2012 | Prevost et al. | |
| 8,397,466 | B2 | 3/2013 | Jenkins | |
| 8,407,951 | B2 | 4/2013 | Haney et al. | |
| 8,424,257 | B2 * | 4/2013 | Jenkins et al. | 52/177 |
| 8,505,256 | B2 | 8/2013 | Cerny et al. | |
| 8,596,023 | B2 * | 12/2013 | Jenkins et al. | 52/747.11 |
| 2001/0002523 | A1 | 6/2001 | Chen | |
| 2002/0108340 | A1 | 8/2002 | Elliott | |
| 2002/0152702 | A1 | 10/2002 | Tseng | |
| 2003/0009971 | A1 | 1/2003 | Palmberg | |
| 2003/0093964 | A1 | 5/2003 | Bushey et al. | |
| 2004/0023006 | A1 | 2/2004 | Mead | |
| 2004/0035079 | A1 | 2/2004 | Evjen | |
| 2004/0182030 | A1 | 9/2004 | Hinault et al. | |
| 2004/0258869 | A1 | 12/2004 | Walker | |
| 2005/0016098 | A1 | 1/2005 | Hahn | |
| 2005/0028475 | A1 | 2/2005 | Barlow et al. | |
| 2005/0102936 | A1 | 5/2005 | Chen et al. | |
| 2005/0144867 | A1 | 7/2005 | Clarke | |
| 2005/0202208 | A1 | 9/2005 | Kelly | |
| 2006/0070314 | A1 | 4/2006 | Jenkins et al. | |
| 2006/0265975 | A1 | 11/2006 | Geffe | |
| 2006/0285920 | A1 | 12/2006 | Gettig et al. | |
| 2007/0214741 | A1 | 9/2007 | Llorens Miravet | |
| 2007/0289244 | A1 | 12/2007 | Haney et al. | |
| 2008/0092473 | A1 | 4/2008 | Heyns | |
| 2008/0127593 | A1 | 6/2008 | Janesky | |
| 2008/0271410 | A1 | 11/2008 | Matthee | |
| 2008/0295437 | A1 | 12/2008 | Dagger | |
| 2009/0049768 | A1 | 2/2009 | Kim | |
| 2009/0235605 | A1 | 9/2009 | Haney | |
| 2010/0107522 | A1 | 5/2010 | Gettig | |
| 2010/0236176 | A1 | 9/2010 | Jenkins et al. | |
| 2011/0045916 | A1 | 2/2011 | Casimaty et al. | |
| 2011/0056158 | A1 | 3/2011 | Moller, Jr. et al. | |
| 2011/0179728 | A1 | 7/2011 | Cerny | |
| 2011/0185658 | A1 | 8/2011 | Cerny | |
| 2012/0085043 | A1 | 4/2012 | Jenkins et al. | |

FOREIGN PATENT DOCUMENTS

| | | |
|---|---|---|
| EP | 1167652 | 1/2007 |
| FR | 2240320 | 3/1975 |
| GB | 1504811 | 3/1978 |
| GB | 2262437 | 6/1993 |
| GB | 2263644 A | 8/1993 |
| GB | 2353543 | 2/2001 |
| JP | 01/226978 | 9/1989 |
| JP | 3045788 | 11/1997 |
| JP | 2000-248729 | 9/2000 |
| KR | 20/0239521 | 10/2001 |
| KR | 10/2006/0127635 | 12/2006 |
| KR | 100743984 | 7/2007 |
| WO | WO 92-01130 | 1/1992 |

OTHER PUBLICATIONS www.mateflex.stores.yahoo.net website Jul. 26, 2006, 68 pages.

www.namintec.com, website, Jul. 26, 2006, 28 pages.

www.polypavement.com/costs.htm, website Mar. 24, 2006, pp. 1-2.

www.polypavement.com/more_info.htm, website Mar. 24, 2006 pp. 1-12.

www.polypavement.com/index.htm, website Mar. 24, 2006, pp. 1-6.

"Standard Test Method for Relative Abrasiveness of Synthetic Turf Playing Surfaces"; Copyright ASTM International; Jul. 10, 2003.

"Standard Test Method for Abrasion Resistance of Textile Fabrics (Rotary Platform, Double-Head Method)"; Copy right by ASTM; Jan. 15, 2009.

U.S. Appl. No. 11/731,017, filed Mar. 28, 2007; Ronald A. Yokubison.

U.S. Appl. No. 11/729,549, filed Mar. 28, 2007; Ronald A. Yokubison.

U.S. Appl. No. 29/361,669, filed May 13, 2010; Mark Jenkins.

U.S. Appl. No. 12/340,555, filed Dec. 19, 2008; Thayne Haney.

PCT Application PCT/US2011/022802; filed Jan. 28, 2011; Ronald N. Cerny; International Search Report mailed Sep. 28, 2011.

Inter Partes Reexamination 95/000,651; filed Dec. 29, 2012; Declaration of Jeremiah Shapiro; filed Nov. 18, 2011.

Inter Partes Reexamination 95/000,651; filed Dec. 29, 2011; Request for Inter Partes Reexamination filed Dec. 29, 2011.

Inter Partes Reexamination 95/000,651; filed Dec. 29, 2011; Office Action mailed Feb. 3, 2012.

Inter Partes Reexamination 95/000,651; filed Dec. 29, 2011; Response to Office Action filed May 2, 2012.

Inter Partes Reexamination 95/000,651; filed Dec. 29, 2011; Petition Under 37 C.F.R. §§ 1.181-.182 for 30 Days From Service to File Third-Party Comments in Inter Partes Reexamination in View of Non-Service of Office Action; Petition filed Apr. 3, 2012.

Inter Partes Reexamination 95/000,651; filed Dec. 29, 2011; Third Party Requester Comments After Non-Final Action filed May 29, 2012.

Inter Partes Reexamination 95/000,651; filed Dec. 29, 2011; Reexam Petition Decision filed Jun. 5, 2012.

Ex Parte Reexamination 90/020,003; filed May 29, 2012; Request for Ex Parte Reexamination.

Inter Partes Reexamination for Patent No. 7,748,177; Request filed Dec. 29, 2011; 192 pages.

U.S. Appl. No. 95/000,651, filed Dec. 29, 2011; office action issued Feb. 3, 2012.

U.S. Appl. No. 12/789,161, filed May 27, 2010; Mark L. Jenkins; office action issued Sep. 1, 2010.

Affidavit of Christopher Butler; signed Jan. 24, 2011; received by Thorpe North and Western on Jul. 8, 2011; 13 pages.

U.S. Appl. No. 60/547,489, filed Feb. 25, 2004; Vaughn W. North.

U.S. Appl. No. 90/020,003, filed May 29, 2012; US 7,748,177 B2; office action (Right of Appeal Notice) mailed Sep. 12, 2014.

* cited by examiner

MODULAR TILE WITH CONTROLLED DEFLECTION

RELATED APPLICATIONS

This application is a continuation of U.S. patent application Ser. No. 12/789,161, filed May 27, 2010, patented as U.S. Pat. No. 8,596,023; which is a continuation of U.S. patent application Ser. No. 11/065,192, filed Feb. 24, 2005, and entitled, "Modular Tile with Controlled Deflection," patented as U.S. Pat. No. 7,748,177 which claims the benefit of U.S. Provisional Patent Application No. 60/547,489, filed Feb. 25, 2004, and entitled, "Modular Tile with Controlled Deflection, " all of which are incorporated by reference in their entirety herein.

FIELD OF THE INVENTION

The present invention relates generally to modular synthetic tiles for use as a floor covering and, more particularly, the present invention relates to a support grid in the tiles.

BACKGROUND OF THE INVENTION AND RELATED ART

Numerous types of flooring have been used to create playing areas for such sports as basketball and tennis, as well as for other purposes. These flooring assemblies include concrete, asphalt, wood and other materials which have varying characteristics. For each type of flooring, there are corresponding advantages and disadvantages. For example, concrete flooring is easy to construct and provides long term wear. However, the concrete provides no "give" during use and many people are injured each year during sporting events due to falls and other mishaps. Wood floors, such as are used for many basketball courts, have an appropriate amount of give to avoid such injuries. The wood floors, however, are expensive to install and require continued maintenance to keep them in good condition.

Due to these concerns, the use of modular flooring assemblies made of synthetic materials has grown in popularity. The synthetic floors are advantageous for several reasons. A first reason for the flooring assemblies' popularity is that they are typically formed of materials which are generally inexpensive and lightweight. If a tile is damaged it may easily be replaced. If the flooring needs to be temporarily removed, the individual tiles making up the floor can easily be detached, relocated, and then reattached to form a new floor in another location. Examples of modular flooring assemblies include U.S. Pat. No. Des. 274,588; U.S. Pat. Nos. 3,438,312; 3,909,996; 4,436,799; 4,008,548; 4,167,599; 4,226,064 and U.S. Pat. No. Des. 255,744.

A second reason for the popularity of the flooring assemblies is that the durable plastics from which they are formed are long lasting. Unlike other long lasting alternatives, such as asphalt and concrete, the material is generally better at absorbing impacts, and there is less risk of injury if a person falls on the plastic material, as opposed to concrete or asphalt. The connections for the modular flooring assembly can even be specially engineered to absorb lateral force to avoid injuries, as is described in U.S. Pat. No. 4,930,286. Additionally, the flooring assemblies generally require little maintenance as compared to other flooring, such as wood. However, there is a need for synthetic flooring to have better impact absorbing qualities than that found in current synthetic flooring materials. In particular, current synthetic flooring does not include characteristics of predictable and controlled deflection within the synthetic tiles under certain predicted load ranges and impacts on the synthetic flooring. Further, the current synthetic flooring materials do not exhibit the spring or bounce characteristics found in wood flooring.

Therefore, it would be advantageous to provide a flooring tile that facilitates greater "give" to impacts as well as providing a spring characteristic to the flooring tile that is comparable or superior to that found in wood flooring while also being easy to manufacture, long lasting and cost efficient. Further, it would be advantageous to provide a flooring tile that has predictable load absorbing characteristics.

SUMMARY OF THE INVENTION

In light of the problems and deficiencies inherent in the prior art, the present invention seeks to overcome these by providing a tile configured to interlock with multiple tiles to form a modular floor covering over a floor, wherein the tile is configured to provide controlled deflection of its support members.

In accordance with the invention as embodied and broadly described herein, the present invention features a tile configured to form a floor covering over a floor. In one exemplary embodiment, the tile comprises (a) a top surface having a periphery defining side walls extending downward from the top surface, the side walls having a coupling portion configured to couple with other tiles adjacent thereto to form the modular floor covering; and (b) a bottom side, opposite the top surface, having a support grid including an array of downward extending polymeric post structures, at least some of the post structures including at least one resilient end portion with a radial end surface configured to be positioned against the floor to facilitate controlled deflection of the post structures.

In another exemplary embodiment the tile comprises (a) a top surface configured to receive and distribute a load; (b) side walls extending downward from the top surface and defining a periphery of the tile; (c) a bottom side, opposite the top surface, having a support grid configured to support the top surface above the floor; (d) a plurality of primary post structures extending downward from and arranged about the bottom side, the primary post structures including at least one end portion in contact with the floor and configured to facilitate controlled deflection of the primary post structures in response to a load; and (e) a plurality of secondary post structures also extending downward from the bottom side and interspaced with or about the primary post structures, the secondary post structures including at least one end portion configured to contact the ground and support the top surface upon deflection of the primary post structures.

The present invention also features a method for manufacturing a tile configured to form a floor covering over a floor. In one exemplary embodiment, the method comprises (a) providing a tile having a top surface, a bottom surface, and sides extending down from the top surface to form a periphery of the tile; (b) arranging a plurality of primary post structures about the bottom side, wherein the primary post structures include at least one end portion in contact with the floor and configured to facilitate controlled deflection of the primary post structures in response to a load; and (c) interspacing a plurality of secondary post structures with or about the primary post structures, wherein the secondary post structures include at least one end portion configured to contact the ground and support the top surface upon the deflection of the primary post structures.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 3(*a*) illustrates an enlarged view of the post structure, depicting end portions of the post structures in a deflected position, according to an embodiment of the present invention;

FIG. 15-B illustrates a detailed side view of the exemplary modular floor tile of FIG. 10.

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art practice the invention, it should be understood that other embodiments may be realized and that various changes to the invention may be made without departing from the spirit and scope of the present invention. Thus, the following more detailed description of the embodiments of the present invention, as represented in FIGS. 1 through 16, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

The present invention describes a method and system for controlling the deflection of a modular tile.

Figure 1:
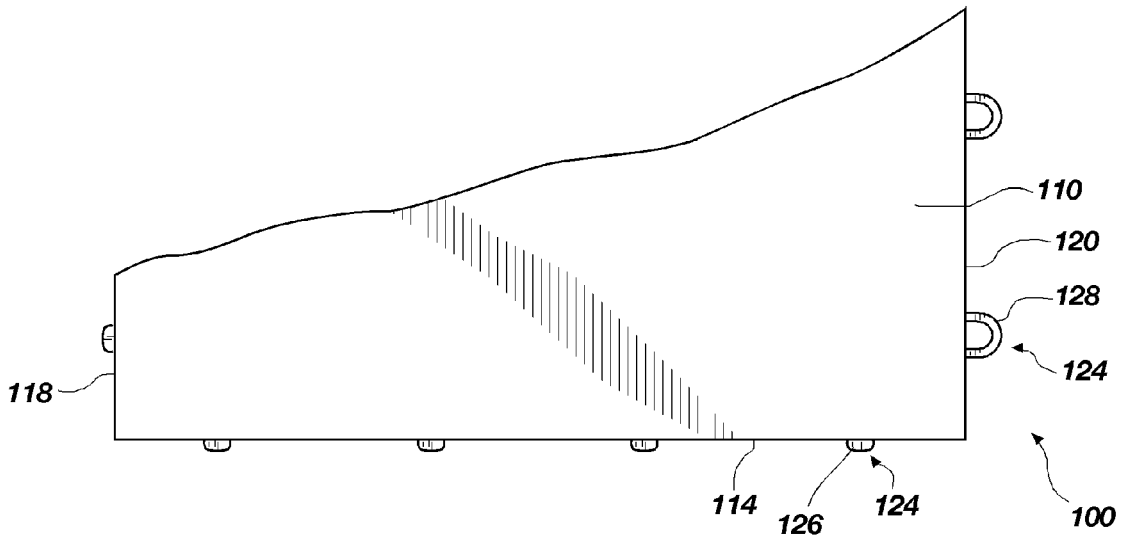
FIG. 1 illustrates a partial top view of a modular tile, depicting coupling portions extending from the tile, according to an embodiment of the present invention.
Figure 2:
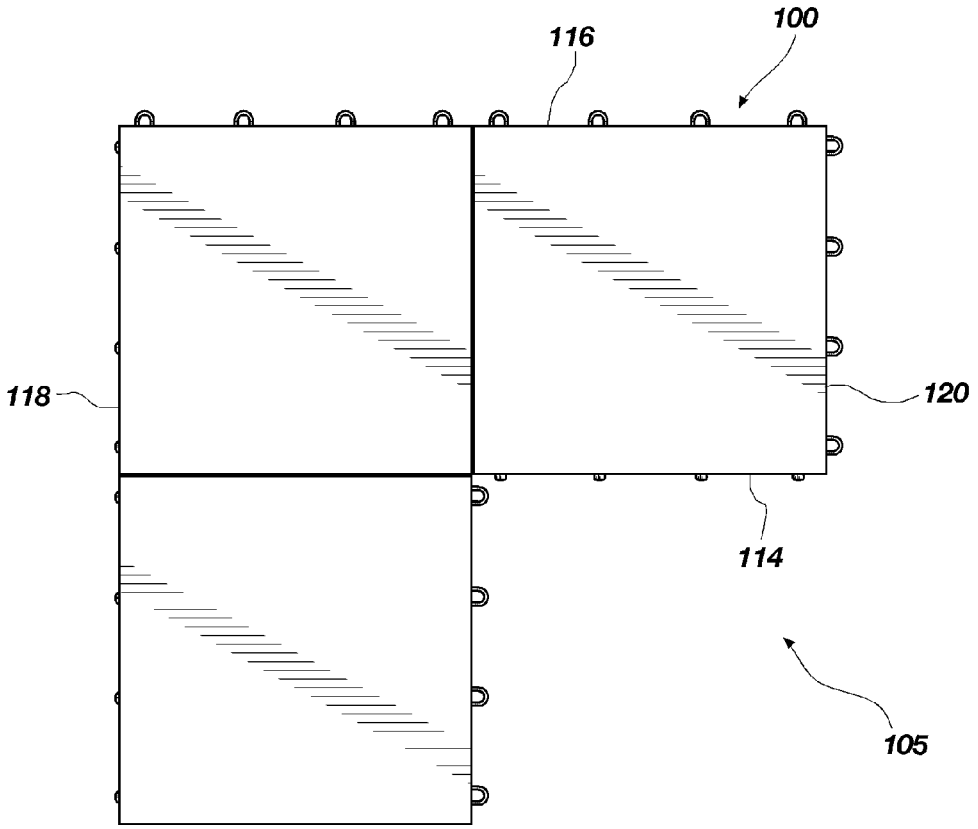
FIG. 2 illustrates a top view of multiple tiles modularly interconnected in an array, according to an embodiment of the present invention.
Figure 3:
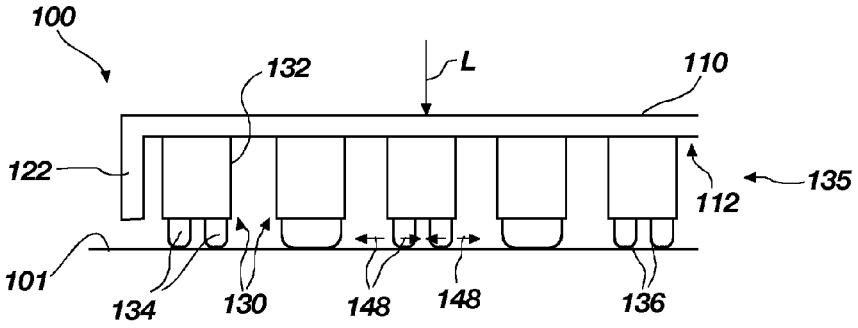
FIG. 3 illustrates a partial profile view of a modular tile, depicting a support grid with post structures for the tile that allows deflection of end portions of the post structures upon a load being placed on the tile, according to an embodiment of the present invention.
Figure 3A:
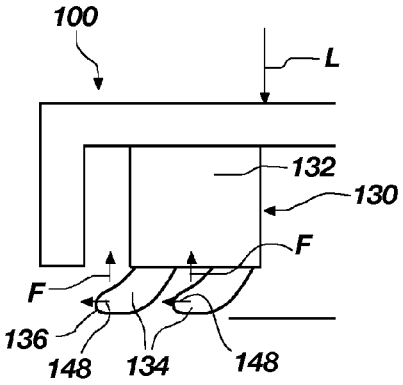

FIGS. 1-3 illustrate a modular tile 100 configured to be interconnected into a tile array 105 to form a floor covering over a floor surface 101, such as a tennis court, basketball court or any other suitable floor surface. The modular tiles 100 of the present invention are configured to provide enhanced "give" or, rather, means for absorbing impacts to facilitate improved safety for the various sporting activities typically conducted on the tile array 105. Further, the tiles 100 of the present invention can provide bounce or spring to those playing on the tile array 105 similar to wood flooring. Such tiles 100 can be formed from any suitable synthetic type material, such as a polymeric material, and formed using conventional molding techniques, such as injection molding, as well known by one of ordinary skill in the art.

The modular tile 100 can include a top surface 110 with an opposite bottom side 112 or under-side. The top surface 110 can be smooth, perforated, grid-like, bumped or any other suitable surface desired for a synthetic tile floor covering. The bottom side 112 may also comprise a smooth, perforated, grid-like, bumped, or other suitable surface configuration. The top surface 110 can include a periphery with a square or rectangular shape, defining a front side 114, a rear side 116, a first side 118 and a second side 120. Other suitable peripheral shapes for the tiles can also be employed, such as triangular, hexagonal, etc.

Each of the front side, rear side, first side and second side can include side walls 122 with one or more coupling portions 124 integrated therewith. In particular, two adjacent sides, such as the first side 118 and the front side 114, can include one or more male coupling portions 126 while the opposite two sides, namely the second side 120 and the rear side 116 can include one or more female coupling portions 128. The male and female coupling portions 126 and 128 of one tile can be configured to complimentarily mate with respective female and male coupling portions of other adjacently positioned tiles. With this arrangement, the tiles 100 can be modularly interconnected, via the male and female coupling portions 126 and 128, into columns and rows to form the tile array 105 for positioning over the floor surface 101.

With reference to FIG. 3, the bottom side 112 of the tile 100 includes a support grid configured to support the top surface 110 of the tile 100. The support grid can include multiple post structures 130 extending downward a length so as to suspend the side walls 122 of the tile 100. The post structures 130 can include an upper portion 132 and one or more end portions 134. The upper portion 132 can extend downward from the bottom side 112 of the tile 100 and the end portions can extend downward from the upper portion 132. In one embodiment, each post structure 130 can include two end portions 134 extending from the upper portion 132. Each end portion 134 can include a radial surface end 136, of which the radial surface end 136 can be configured to be positioned against and directly contact the floor surface 101. The end portions 134 can be sized and configured to be flexible and resilient as well as durable.

With reference to FIGS. 3 and 3(*a*), the end portions 134 of the post structures 130 are configured to absorb impacts applied at the top surface of the modular tile 100. In particular, when a load L or impact is applied to the top surface 110, the radial surface end 136 of the end portions below the load L induces such end portions 134 to displace against the floor surface 101 and be forced in a lateral direction 148 to a lateral deflected position. As can be appreciated by one of ordinary skill in the art, the direction by which the end portions 134 slide and deflect can be dependent upon the placement and direction of the load L with respect to the radial surface end 136 of the end portions 134. When such load L is removed, the end portions 134 can resiliently move back to their original position. Further, as the end portions 134 are in a load bearing deflected position, the end portions provide an upward spring force F due to the resilient characteristic of the end portions 134. With this arrangement, the end portions 134 facilitate impact absorbency or "give" in the tile to provide a greater degree of safety for those on the tiles 100 as well as provide additional spring in the tiles 100.

Further, the end portions 134, in this embodiment, can resiliently deflect while the upper portion 132 of the post structures 130 can be configured to have a substantially maintained position. As such, the upper portion 132 of each of the post structures 130 provides the necessary support for the tiles 100 while the end portions 134 provide the impact absorbency component for the tiles 100. As one of ordinary skill in the art can readily appreciate, the end portions 134 of the post structures 130 can be modified in size and configuration according to the amount of controlled deflection or impact absorbency desired for an intended use or activity for playing on the tiles 100. Further, the type of synthetic material employed for the tiles 100 can also be a factor for the size and configuration of the post structures 130 to provide the amount of deflection or impact absorbency desired in the tiles 100.

Figure 4:
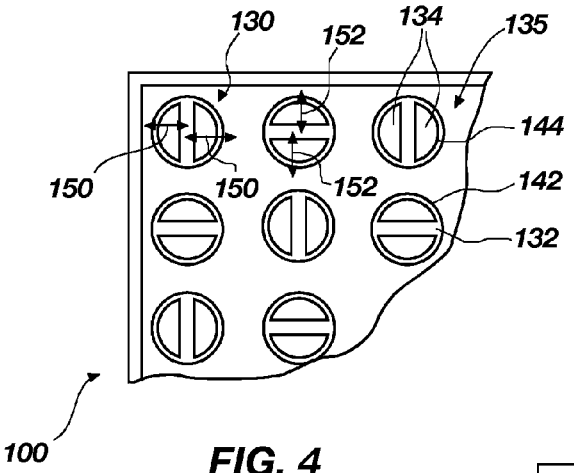
FIG. 4 illustrates a partial bottom view of the support grid of the tile in FIG. 3, depicting end portions oriented to deflect in first and second bi-lateral directions, according to an embodiment of the present invention.

With reference to FIG. 4, a bottom view of the support grid is depicted, illustrating the post structures 130 in a post structure array 135 of rows and columns. In one embodiment, the upper portion 132 of the post structures 130 can include a circular periphery 142. As such, the upper portion can have a cylindrical shape or conical shape. Further, each post structure 130 can include two end portions 132, spaced apart, with opposing outer circular peripheries 144. As depicted, the end portions 134 for one post structure 130 can be oriented to allow the end portions 134 to controllably deflect in a first bi-lateral direction 150 and the end portions 134 for an adjacent post structure 130 can be oriented to allow the end portions 134 to controllably deflect laterally in a second bi-lateral direction 152. The first bi-lateral direction 150 can be transverse to the second bi-lateral direction 152. In this manner, the orientation of the end portions 134 in the post structure array 135 can be a checkered orientation configuration. Other orientation configurations can also be implemented, such as staggered orientation configurations, row orientation configurations, column orientation configurations, etc. For example, a column orientation configuration can include the orientation of the end portions 134 being similarly oriented within one column with the first bilateral direction 150 and an adjacent column can include orientations of the end portions 134 with the second bilinear direction 152. As one of ordinary skill in the art can readily appreciate, there are numerous orientation configurations that can be implemented in the post structures to control the directional deflection or movement of the end portions 134 and, further, control the impact absorbency of the tiles 100.

Figure 5:
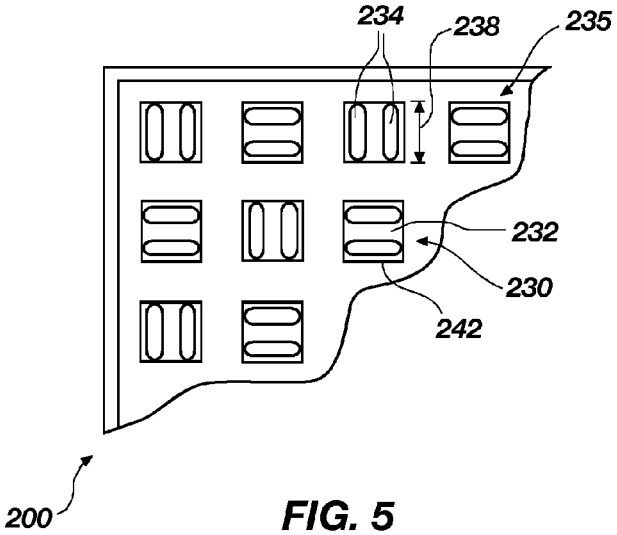
FIG. 5 illustrates a partial bottom view of another embodiment of the modular tile depicted in FIG. 3, depicting the end portions having an elongated configuration and oriented to deflect in the first and second bi-lateral directions, according to the present invention.

With reference to FIG. 5, in another embodiment of the modular tile 200, the upper portion 232 of the post structures 230 can include a square periphery 242. As in the previous embodiment, there can also be two end portions 234 extending downward from the upper portion 232 of the post structures 230, as depicted and described with respect to FIG. 3. In this embodiment, the two end portions 234, for one post structure 230, can be elongated at least partially along a width 238 of the post structure 230, spaced apart, and oriented substantially parallel to each other. The elongated structure of the end portions 234 can facilitate resilient deflection of the end portions 234 with controlled bi-lateral movement, as in the embodiment previously set forth. Further, the orientation configuration of the respective end portions 234 in the post structure array 235 can be in a checkered orientation configuration, or any other suitable orientation configuration as set forth in the previous embodiment.

Figure 6:
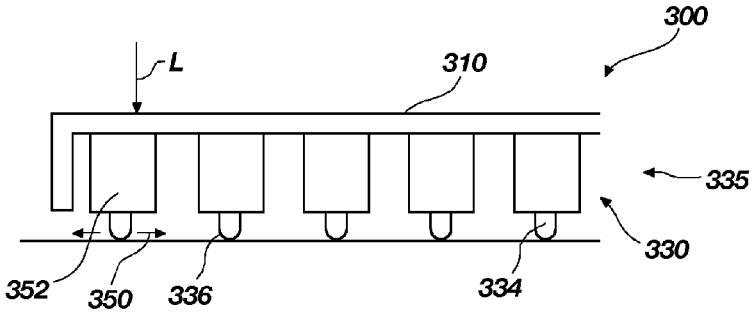
FIG. 6 illustrates a partial profile view of another embodiment of a modular tile, depicting the post structures of the support grid having a single end portion extending therefrom, according to the present invention.
Figure 7:
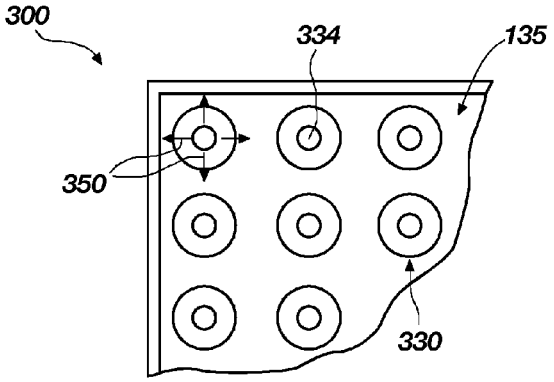
FIG. 7 illustrates a partial bottom view of the support grid of the modular tile in FIG. 6, according to an embodiment of the present invention.

FIGS. 6 and 7 illustrate another embodiment of the support grid of the modular tile 300 including the post structure array 335. In this embodiment, the post structures 330 can include a single end portion 334 configured to extend downward from the upper portion 332 of the post structure 330. As in the previous embodiments, the end portion 334 can include a radial surface end 336 to facilitate resilient deflection in a lateral direction dependent upon the position of the load L applied at the top surface 310. In this embodiment, the end portions 334 can be an elongated projection extending downward from the upper portion 332 of the post structure 330. Further, the end portions 334 can resiliently deflect in any suitable lateral direction 350 with respect to a longitudinal axis 352 of the post structure 330.

Figure 8:
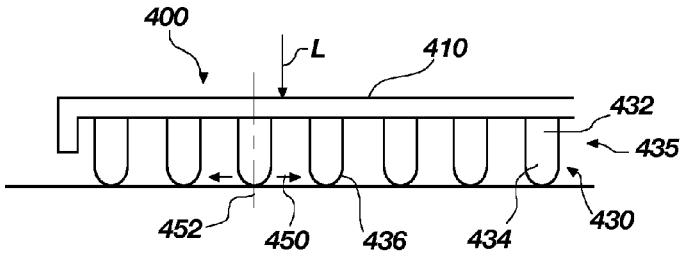
FIG. 8 illustrates a partial profile view of another embodiment of a support grid of a modular tile, according to the present invention.

FIG. 8 illustrates another embodiment of the post structure array 435 at the bottom side 412 of the tile 400. In this embodiment, the post structures 430 can include an end portion 434 with a cross-sectional area similar to the upper portion 432 of the post structures 430. The cross-section of each of the post structures 430 can be sized and configured such that the end portions 434 can provide the impact absorbency intended by being resiliently deflectable while also providing sufficient support at the upper portion 432 of the post structures 430. As in the previous embodiments, the end portions 434 can include the radial surface end 436 to readily facilitate lateral sliding against the floor surface 101 upon a load L being applied to the top surface 410 of the tile 100. In one embodiment, the post structures 430 can be sized and configured so that the end portions 434 can resiliently deflect in any suitable lateral direction 450 with respect to a longitudinal axis 452 of the post structure 430, as in the previous embodiment. Alternatively, the post structures 430 can be sized and configured to be elongated along their width to control the direction of lateral movement by which the end portions 434 can bend, similar to that described and depicted with respect to FIG. 5.

Figure 9:
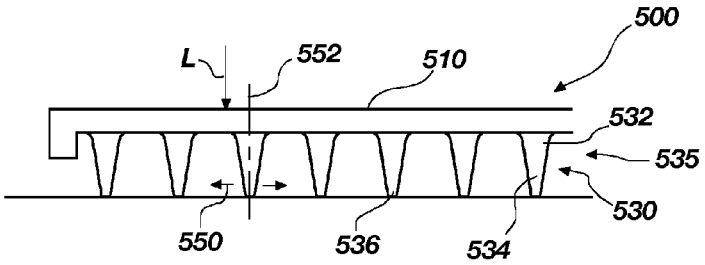
FIG. 9 illustrates a partial profile view of another embodiment of a support grid of a modular tile, according to the present invention.

FIG. 9 illustrates another embodiment of the tile 500 with the post structure array 535. The post structures 530 in this embodiment can taper downward to an end portion 534, wherein the end portion 534 can include a radial surface end 536. As such, the end portion 534 of each of the post structures 530 can be resiliently deflectable upon a load L being applied to the top surface 510 of the tiles 500, similar to the previous embodiments. The post structures 530 in this embodiment can be conical, pyramidal, or any other suitable tapering post structure, such as an elongated width structure to facilitate directional control in the deflection of the end portions 534. In one embodiment where the post structures 530 are conical, the end portions 534 can resiliently bend in any suitable lateral direction 550 with respect to a longitudinal axis 552 of the post structure 530. In an alternative embodiment where the post structures 530 include an elongated width, the direction by which the end portions resiliently deflect can be substantially controlled to bend with bi-lateral movement.

As one of ordinary skill in the art can readily appreciate, the post structures of the present invention can include various configurations that can deflect under various ranges of loads and impacts. As such, the configuration of the post structures can be formed with deflection control to deflect at particular load ranges by, for example, manipulating the radius of curvature of the end portions, sizing the cross-sectional area of the end portions and/or sizing the upper portions of the post structures to withstand over-deflection, manipulating the orientation configuration of the post structures to control the direction of deflection of the post structures, etc. For example, the radius of curvature in the end portions' radial surface end can be smaller in the embodiment depicted in FIG. 9 compared to the radius of curvature in the end portions depicted in FIG. 8. As such, the end portions depicted in FIG. 8 may require a larger load or impact to effect deflection of the end portions than that required in the end portions depicted in FIG. 9. Such various configurations of the post structures can be determined by one of ordinary skill in the art to facilitate the controlled deflection desired for a given type of activity predicted to be played on the array of tiles.

FIGS. 10-16 illustrate various features of a modular tile configuration according to another exemplary embodiment of the present invention. The modular tile illustrated in FIGS. 10-16 is similar to the exemplary modular tiles discussed above and shown in the drawings. However, this particular modular tile embodies an alternative controlled deflection concept.

Figure 10:
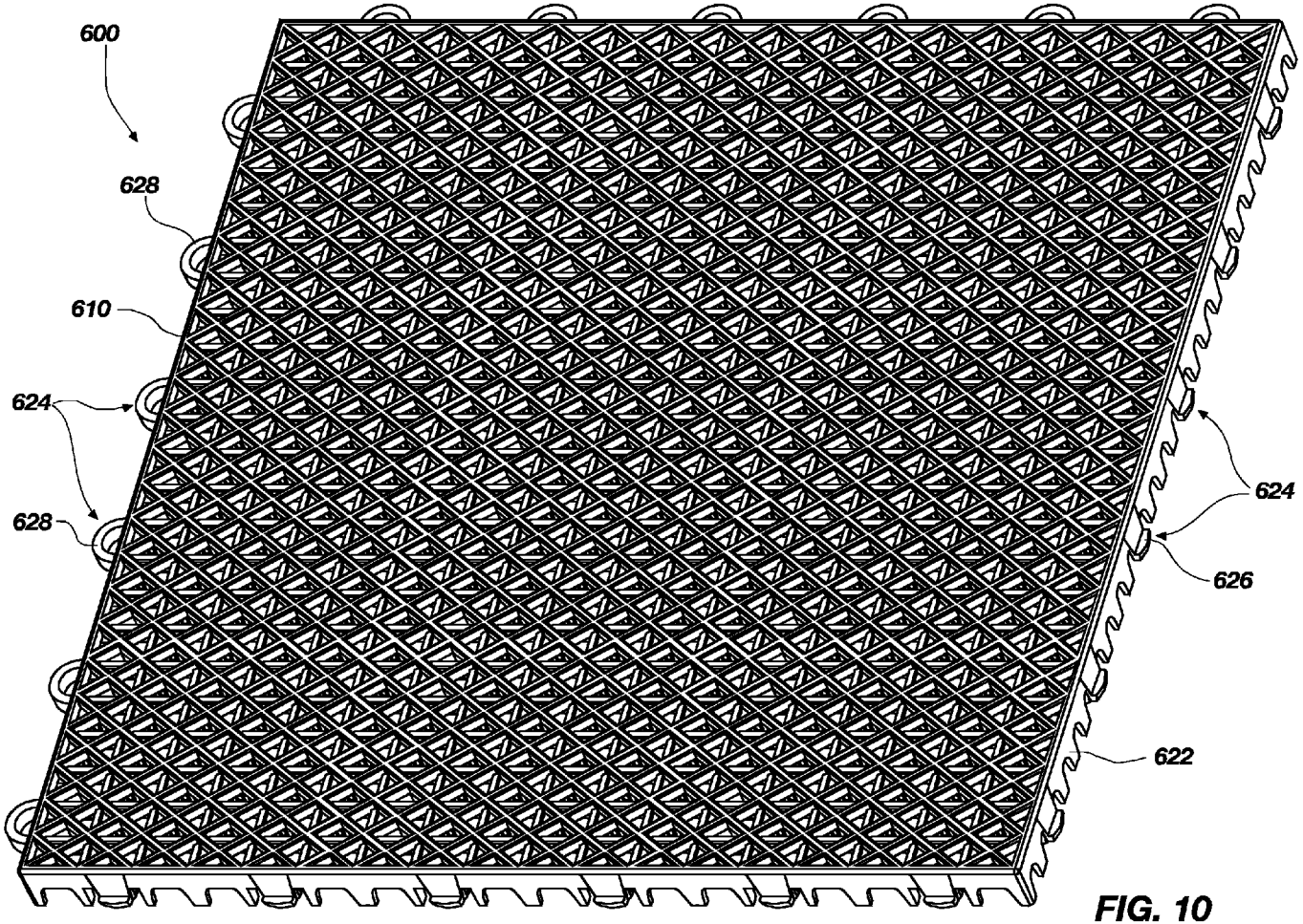
FIG. 10 illustrates a perspective view of a modular tile according to another exemplary embodiment of the present invention, wherein the modular floor tile comprises a plurality of primary post structures and a plurality of secondary post structures comprising a shorter length than the primary post structures, such that the secondary post structures are caused to contact the floor upon deflection of the primary post structures under a given load.

With reference to FIG. 10, illustrated is a perspective view of an exemplary modular tile 600 having a bi-level or multi-level surface structure. However, other single level surface tile configurations may also be used with the controlled deflection concept discussed herein, thus the illustration of a bi-level surface is not meant to be limiting in any way. Indeed, the controlled deflection concept discussed herein with reference to FIGS. 10-16 may be incorporated into any single surface tile configuration, such as those discussed above in reference to FIGS. 1-9.

The modular tile 600 is configured to be interconnected with a plurality of other tiles to form a tile array, such as the one described above, for the purpose of forming a floor covering over a floor surface, similar to those identified above. As the modular tiles described above are designed to do, the modular tile 600 shown in FIG. 10 is configured to provide enhanced "give" or, rather, means for absorbing impacts to facilitate improved safety for the various sporting activities typically conducted on the tile array. Further, the modular tile 600 of the present invention can provide bounce or spring to those playing on the tile array in a similar manner as wood flooring and the like. The modular tile 600 is also configured to perform other functions that will be addressed below or that will be obvious to those skilled in the art. The modular tile 600 may be formed from any suitable synthetic type of material, such as a polymeric material, and may be formed using conventional molding techniques, such as injection molding, and others that are commonly known.

With reference to FIGS. 10-13, the modular tile 600 includes a surface configuration. In one aspect, the tile 600 can include a surface 610 with an opposite bottom side or under-side and sidewalls defining a periphery. The top surface 610 can be smooth, perforated, grid-like, bumped or any other suitable surface desired for a synthetic tile floor covering. The bottom side may also be smooth, perforated, grid-like, bumped or any other suitable surface. As shown, the surface 610 of the modular tile 600 comprises a bi-level surface, or a plurality of surfaces. An upper surface 611 is defined by a diamond-shaped grid-like pattern. A lower surface 613 is defined by a square-shaped grid-like pattern formed and operable with the upper surface 611. The modular tile 600 can include a periphery with a square or rectangular shape, defining a front side 614, a rear side 616, a first side 618 and a second side 620. Other suitable peripheral shapes for the modular tile 600 can also be employed, such as triangular, hexagonal, etc.

Each of the front side 614, rear side 616, first side 618 and second side 620 can include side walls 622 with one or more coupling portions 624 integrated therewith. In particular, two adjacent sides, such as the first side 618 and the front side 614, can include one or more male coupling portions 626 while the opposite two sides, namely the second side 620 and the rear side 616 can include one or more female coupling portions 628. The male and female coupling portions 626 and 628 of one tile can be configured to complimentarily mate with respective female and male coupling portions of other adjacently positioned tiles. With this arrangement, the several tiles can be modularly interconnected, via the male and female coupling portions 626 and 628, into columns and rows to form a tile array for positioning over the surface of a floor.

Figure 11:
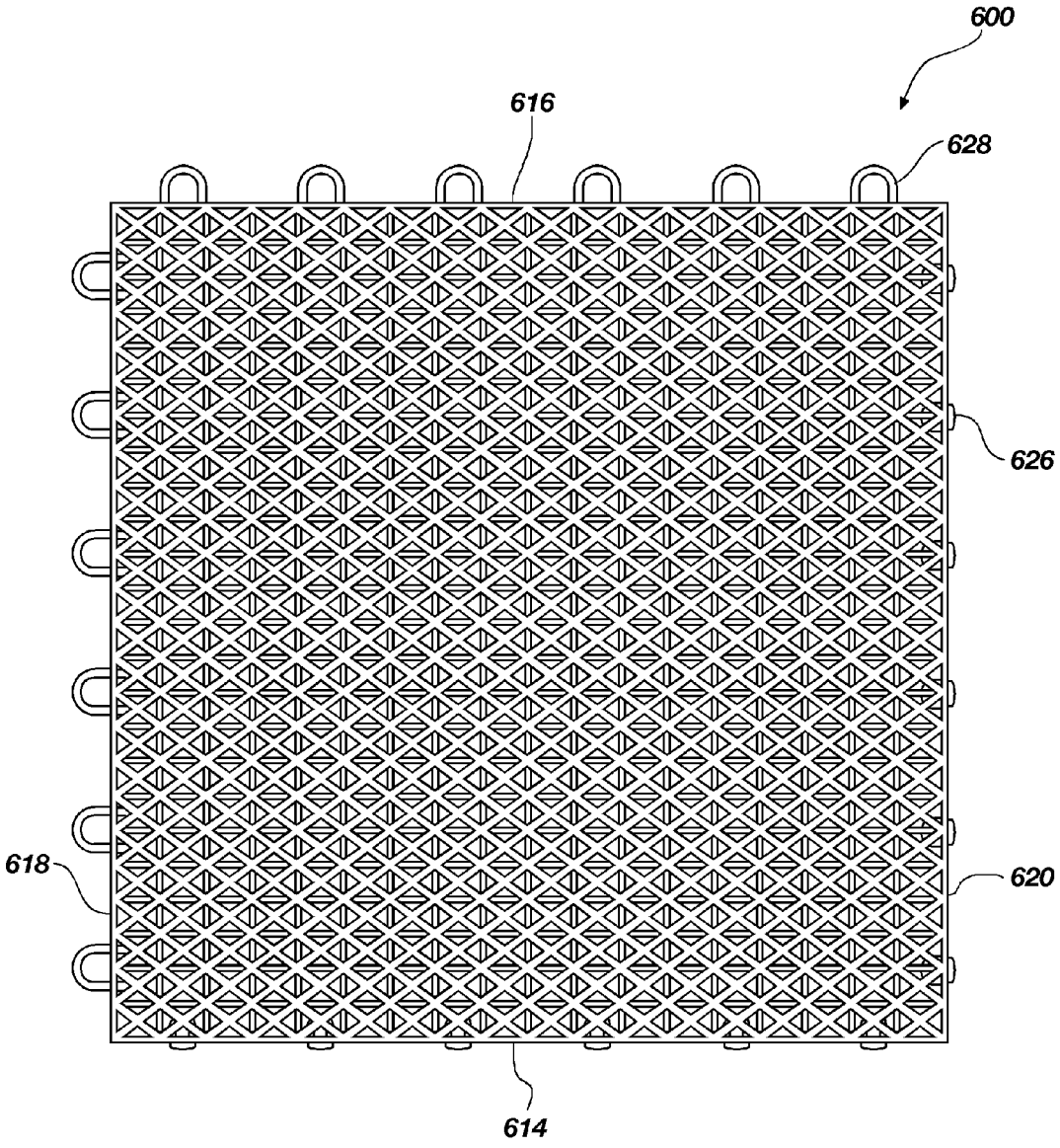
FIG. 11 illustrates a top view of the surface of the exemplary modular floor tile of FIG. 10.
Figure 12:
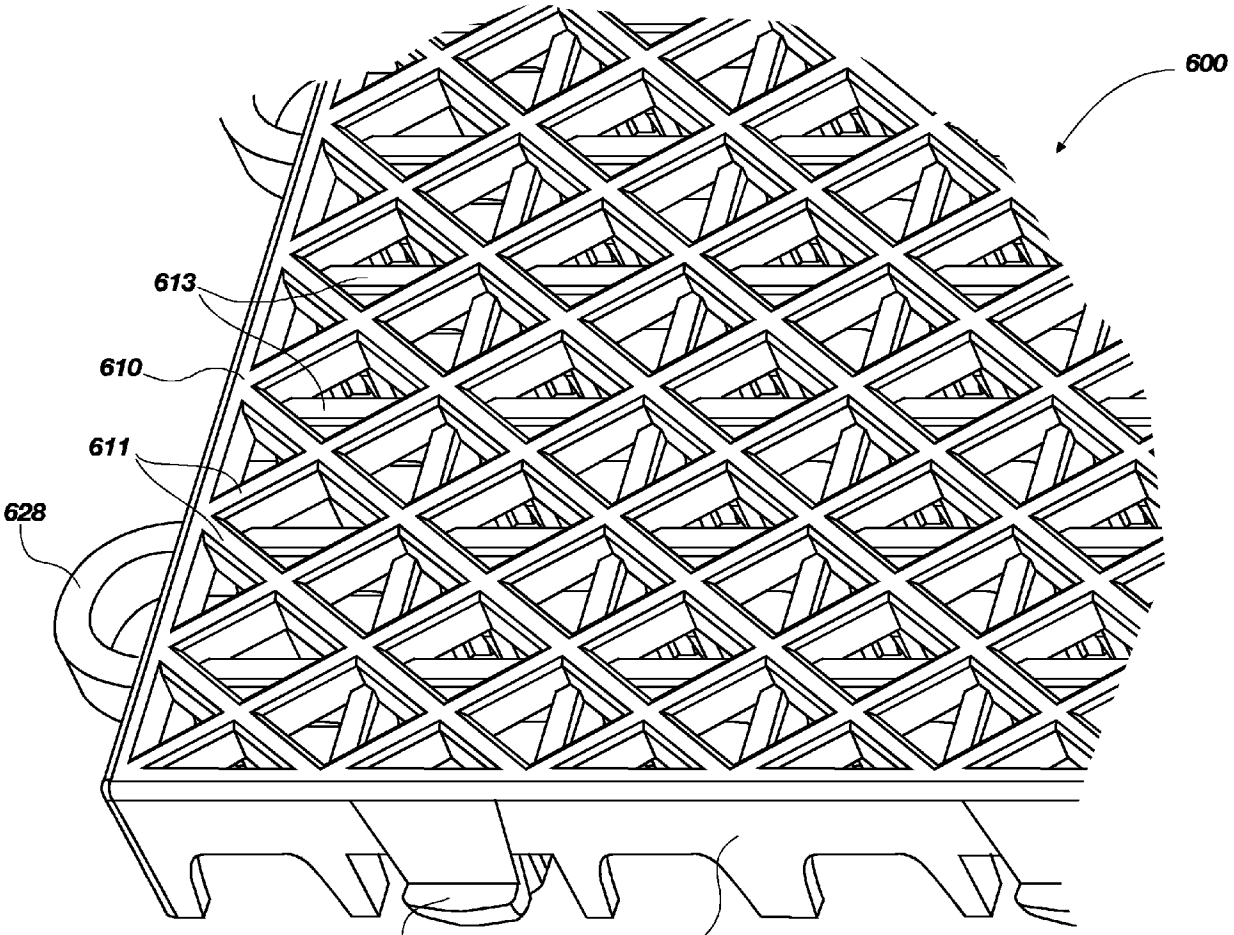
FIG. 12 illustrates a detailed perspective view of the surface of the exemplary modular floor tile of FIG. 10.
Figure 13:
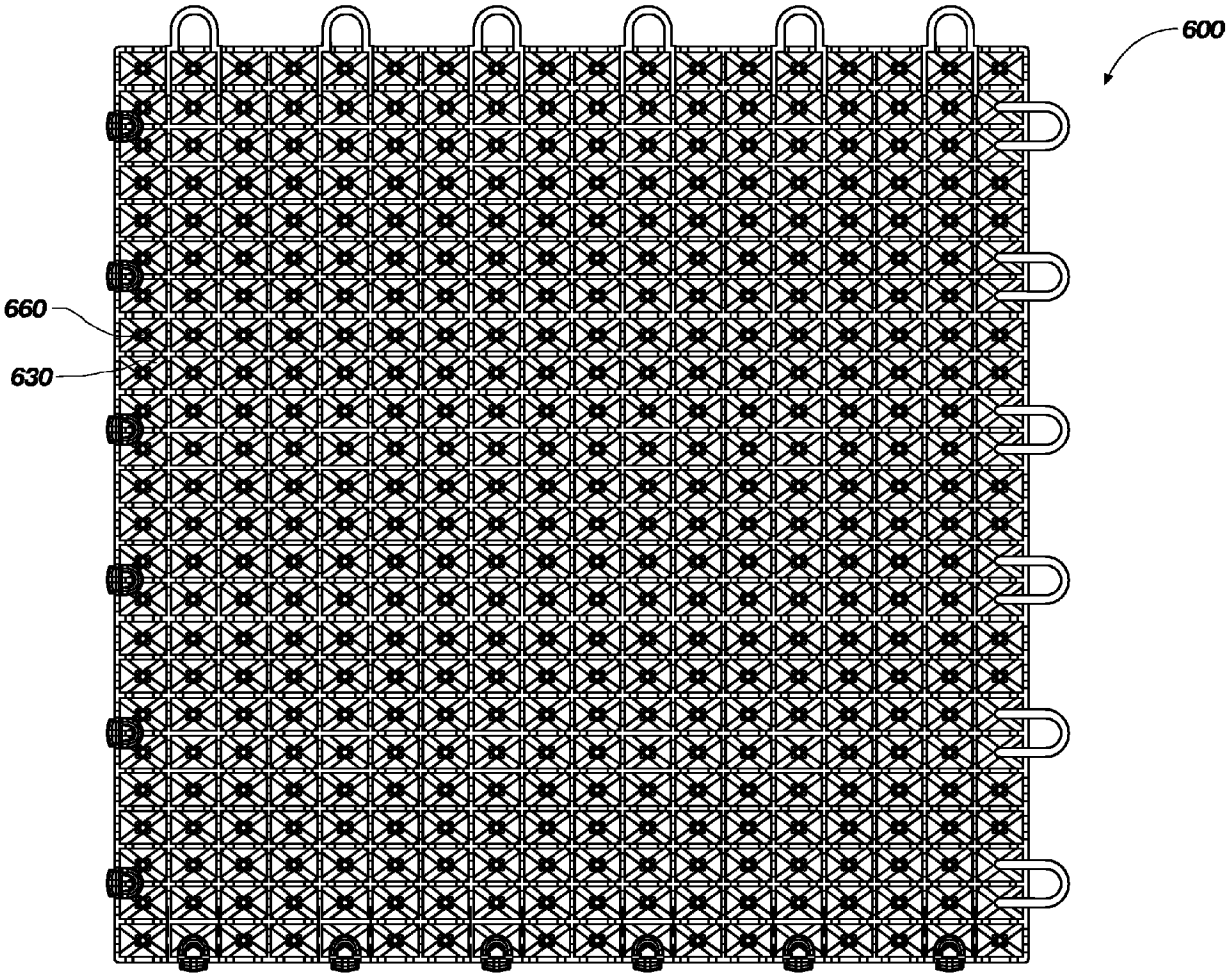
FIG. 13 illustrates a rear view of the post structure configuration of the exemplary modular floor tile of FIG. 10.

With reference to FIGS. 13 and 14, illustrated are respective rear views of the modular tile 600 shown in FIGS. 10-12, and described above, with FIG. 14 illustrating a detailed rear view of a portion of the modular tile 600. The bottom side of the tile 600 includes a support grid configured to support the top surface 610 of the tile 600. The support grid can include multiple post structures in the form of primary and secondary post structures 630 and 660, each extending downward a length from the bottom side. The primary post structures 630 include an upper portion 632 and one or more end portions 634. The upper portion 632 can extend downward from the bottom side of the tile 600 and the end portions 634 can extend downward from the upper portion 632. The primary post structure 630 may comprise any shape, size, and configuration, such as those discussed above in relation to FIGS. 1-9. Likewise, the secondary post structures 660 include an upper portion 662 and one or more end portions 664. The upper portion 662 can extend downward from the bottom side of the tile 600 and the end portions 664 can extend downward from the upper portion 662. These also can be any shape, size, and configuration. The primary and secondary post structures 630 and 660 are arranged about the bottom side of the tile according to any conceivable arrangement, which may include a patterned arrangement, a random arrangement, and a layered arrangement.

Figure 14:
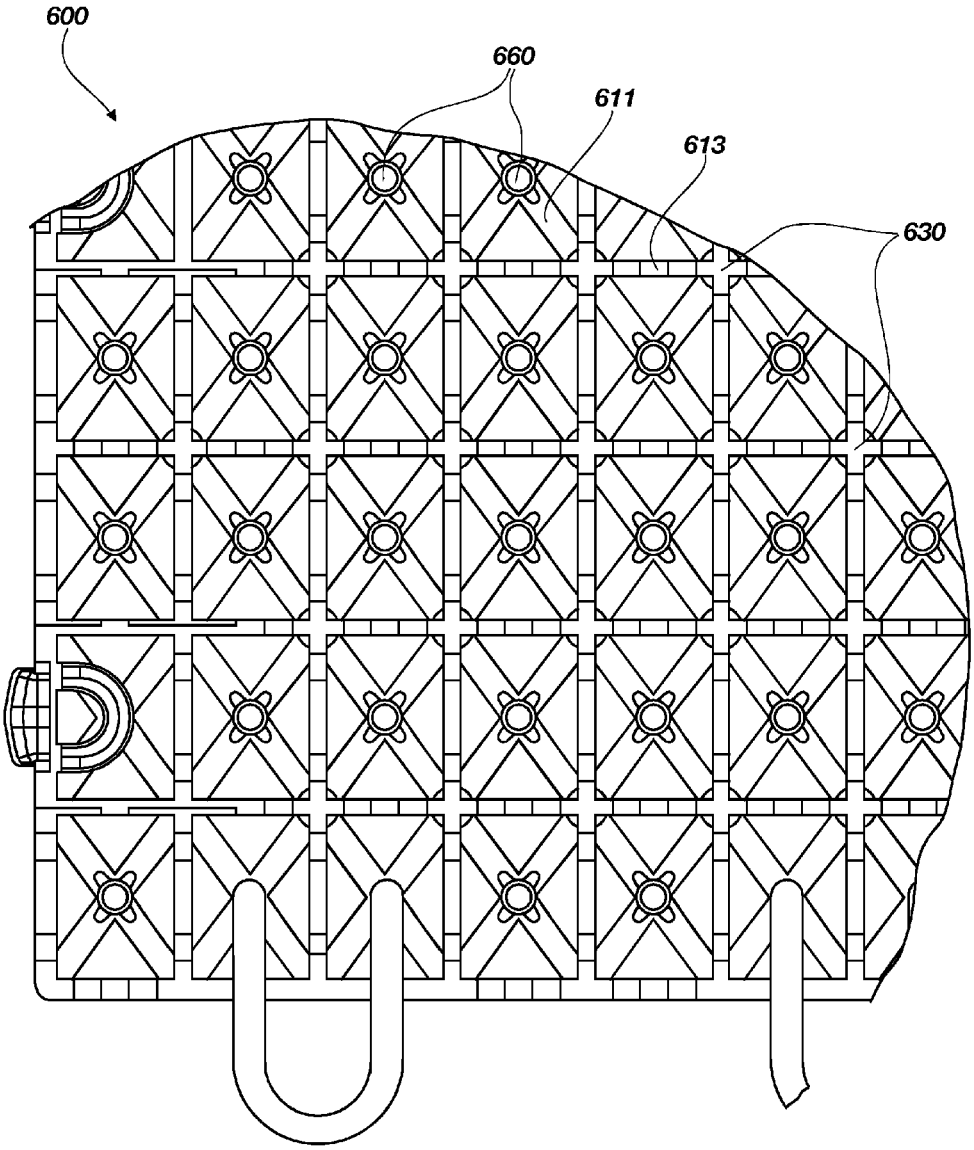
FIG. 14 illustrates a detailed rear view of the post structure configuration of the exemplary modular floor tile of FIG. 10.
Figure 15A:
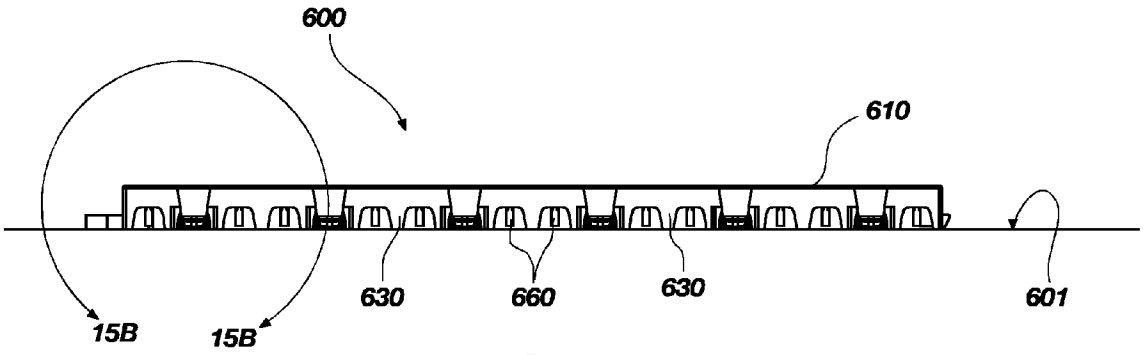
FIG. 15-A illustrates a side view of the exemplary modular floor tile of FIG. 10.
Figure 15B:
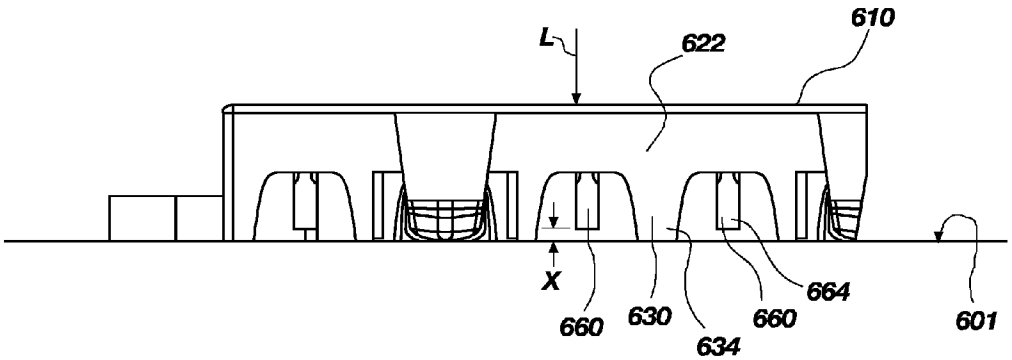

As shown, the modular tile 600 comprises a plurality of primary post structures 630 interspaced with a plurality of secondary post structures 660 to comprise the support for the modular tile 600, and particularly the surface 610 of the modular tile 600. More specifically, each secondary post structure 660 is positioned to be immediately adjacent or surrounded by four primary post structures 630 located at quadrant positions. In addition, each primary post structure 630 is immediately adjacent or surrounded by at least four secondary post structures 660. This alternating pattern of primary and secondary post structures is repeated several times to comprise the support structure of the modular tile 600. The particular post structure pattern, as well as the spacing between the various primary and secondary posts, as shown in FIGS. 13 and 14, is not meant to be limiting in any way, but instead comprises merely one exemplary arrangement.

The primary post structures 630 are formed from or are extensions of or are coupled to the underside of the lower surface 613. The primary post structures 630 are intended to contact the floor or ground at all times, and are considered the primary support structures for the modular tile 600. In addition, the primary post structures 630 are configured to deflect laterally instead of to deform (e.g., mashing). On the other hand, the secondary post structures are formed from or are extensions of or are coupled to the underside of the upper surface 611. The secondary post structures 660 are designed to terminate a pre-determined distance so that their ends are not in contact with the floor when the modular tile 600 is subject to non-deflecting loads (loads below the primary load threshold described below) or no load at all. As will be explained below, the secondary post structures 660 are configured to contact the floor or ground only in the event all or a portion of the upper surface 610 of the tile is subject to an applied load capable of deflecting the primary post structures 630 a sufficient distance to cause the secondary post structures 660 to displace toward and contact the floor or ground. Some of the purposes or functions of the secondary post structures 660 are to control the deflection of the primary post structures 630, or rather to limit the degree of deflection of the primary post structures 630; to improve the durability of the modular tile 600 in response to applied loads; to increase the load bearing capabilities of the modular tile 600, to help prevent premature or inadvertent damage to the modular tile 600 under applied loads; and to preserve and improve the integrity, functionality, and operability of the modular tile 600.

It is noted that the secondary post structures of the modular tile 600 described herein may also be incorporated into any of the modular tile configurations described above and shown in FIGS. 1-9. For example, the post structures 130 identified above and illustrated in FIG. 3 may be termed as primary post structures, with the modular tile 100 comprising a plurality of secondary post structures positioned between or arranged about the primary post structures according to a pre-determined post structure pattern or arrangement, as taught herein. The concept of primary and secondary post structures as disclosed herein may also be incorporated into other floor tile designs not specifically described and shown herein, as will be appreciated and apparent to those skilled in the art.

With reference to FIGS. 15-A and 15-B, illustrated are respective side views of the modular tile 600 shown in FIGS. 10-14 and described above, with FIG. 15-B illustrating a detailed side view of a portion of the modular tile 600. As shown, the primary post structures 630 extend downward from the underside of the lower surface (not shown, but see surface 613 in FIG. 12) and comprise end portions 634 that are configured to be in contact with the floor or ground 601 at all times. The secondary post structures 660 extend downward from the underside of the upper surface (not shown, but see upper surface 611 in FIG. 12) and comprise end portions 664 configured to terminate at a position above the floor 601 a distance x. This distance x may vary as desired. As such, the secondary post structures 660 may comprise the same or a different length than the primary post structures 630, depending upon the surface configuration of the modular tile 600. For example, the secondary post structures 660 may comprise a different length than the primary post structures both are extending from a single surface configuration; and they may comprise the same or a different length if each is extending from different surfaces of a bi-level surface configuration. In addition, the size of the primary and secondary post structures 630 and 660 may be the same or different. In essence, the size, shape, configuration, pattern, location, and number of primary and secondary post structures, and may vary depending upon the functional performance desired to be achieved by a particular modular tile.

The secondary post structures 660 are configured to activate and contact the floor 601 only upon sufficient deflection of the primary post structures 630 adjacent the secondary post structures 660 in response to a load or impact L. Depending upon the distribution area of the applied load to the surface 610 of the modular tile 600, one or more primary post structures 630 may deflect a sufficient distance to cause one or more secondary post structures 660 to contact the floor 601.

Figure 16:
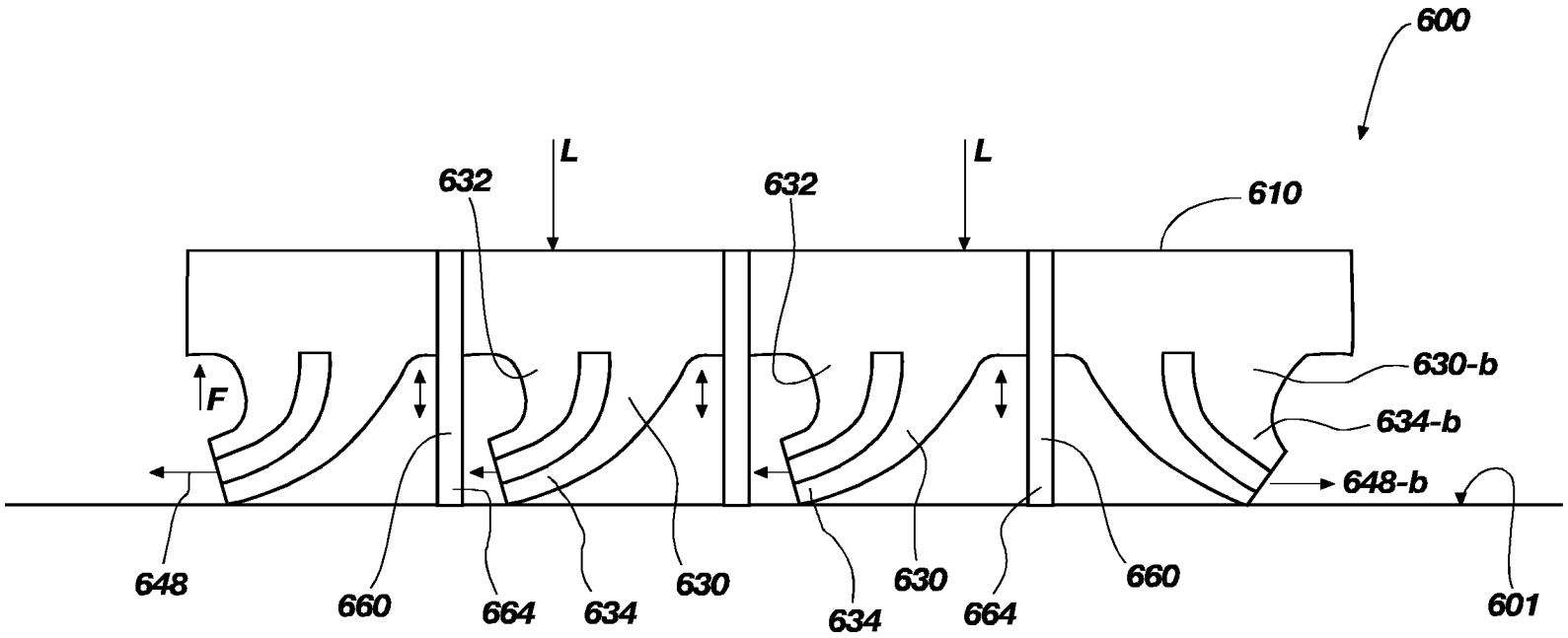
FIG. 16 illustrates a detailed side view of the exemplary modular floor tile of FIG. 10 showing the deflection positions of the primary post structures and the downward displacement of the secondary post structures to engage or contact the floor.

With reference to FIG. 16, illustrated is a cross-sectional side view of a portion of the modular tile 600 depicting exemplary deflection positions of several primary post structures 630 under a load L, as well as the contact positions of several secondary post structures 660 with respect to the floor 601. As in other embodiments, the end portions 634 of the primary post structures 630 are configured to absorb impacts applied at the surface 610 of the modular tile 600. In particular, when a load L or impact is applied to the top surface 610, the end portions 634 of the primary post structures 630 within the distribution area of the load L are caused to displace against the floor surface 601 and be forced in a lateral direction 648 to a lateral deflected position. As can be appreciated by one of ordinary skill in the art, the direction by which the end portions 634 slide and deflect can be dependent upon the placement and direction of the load L. For example, FIG. 16 illustrates several primary post structures 630 deflecting in one direction in response to the load L, as well as the deflection of primary post structure 630-*b* in another opposite direction.

As will be apparent to one skilled in the art, the magnitude of the load L will determine the magnitude of deflection of the primary post structures 630. Some loads may cause nominal or marginal deflection of the primary post structures 630 such that the secondary post structures 660 are not caused to contact the floor 601. Under a sufficient pre-determined load L, the primary post structures 630 are caused to laterally deflect, which results in the displacement of the surface 610 of the modular tile 600 toward the floor 601 as a result of the shortening effect on the primary post structures 630 caused by their deflection. As the surface 610 displaces downward toward the floor 601, the secondary post structures 660 are caused to also displace in a downward direction towards the floor 601. If the load L is great enough, the end portions 664 of the secondary post structures 660 are caused to engage or come in contact with the floor 601, thus activating the secondary post structures 660 as support members for the modular tile 600. Due to their structural formation, the secondary post structures 660 function as additional supports for the modular tile 601 in response to the load L. The secondary post structures 660 are also designed to support the primary post structures 630, up to a pre-determined threshold. Of particular note is the ability of the secondary post structures 660 to control or limit the deflection of the primary post structures 630 and support the modular tile 600 and primary post structures 630 under a sufficient given load L by contacting the floor 601. In other words, the secondary post structures 660 function as additional support members of the modular tile 600 under loads large enough to deflect the primary post structures 630 and cause the secondary post structures 660 to come in contact with the floor 601. In one exemplary embodiment, the breach of a primary load threshold at and above 160 psi will cause the primary post structures 630 to deflect enough to enable the secondary post structures 660 to displace and contact the floor. Of course, the present invention is not limited in any way by this. The primary load threshold for causing the primary post structures to deflect enough to cause the secondary post structures to activate and displace to contact the floor may be pre-determined and may be set at any desirable limit, depending upon, among other things, the construction, configuration, post structure pattern, and/or material make-up of the modular tile. Preferably, this primary load threshold will range between 100 and 300 psi, as this is a reasonable range corresponding to the weight range of different individuals that might be using the tiles, and the forces that may be induced upon the tiles by them.

The modular tile also has a secondary load threshold. Loads below this secondary load threshold and in excess of the primary load threshold define acceptable operating conditions that allow the modular tile to remain functional without deflection or deformation of the secondary post structure. This secondary load threshold is also pre-determined and may be set at any desirable limit. The secondary load threshold defines the load that the secondary post structures, along with the deflected post structures, may bear without deflecting or deforming (e.g., being mashed), thus possibly damaging the modular tile. Loads in excess of this secondary load threshold will cause a degree of deflection and/or deformation of the secondary post structures, some of which may be acceptable, and which may result without damage to the modular tile. Indeed, the primary and secondary posts are elastically deformable up to a pre-determined load. However, the modular tile is also designed with a maximum load threshold. The maximum load threshold describes or defines the load that modular tile is able to bear without being damaged. Again, this maximum load threshold is pre-determined and may be set at any desirable limit. Loads in excess of this maximum load threshold will cause irreversible damage to the modular tile and cause the primary and secondary posts, the surface, and/or other vital components of the modular tile to inelastically deform.

Under normal operating conditions, when the load L is removed, the end portions 634 of the primary post structures 630 resiliently move back to their original position, thus also causing the end portions 664 of the secondary post structures 660 to disengage the floor 601 and return to their normal, inactive position. Furthermore, in the event the end portions 634 are in a load bearing deflected position, they are capable of providing an upward spring force F, due to the resilient characteristics of the end portions 634. With this arrangement, the end portions 634 facilitate impact absorbency or "give" in the tile to provide a greater degree of safety for those using the modular tiles 600. They also provide additional spring in the tiles 600.

As in other embodiments, the end portions 634, in this embodiment, can resiliently deflect while the upper portion 632 of the post structures 630 can be configured to have a substantially maintained or stationary position. As such, the upper portion 632 of each of the post structures 630 provides the necessary support for the tiles 600 while the end portions 634 provide the impact absorbency component for the modular tiles 600. As one of ordinary skill in the art can readily appreciate, the end portions 634 of the primary post structures 630 can be modified in size and configuration according to the amount of controlled deflection or impact absorbency desired for an intended use or activity for playing on the modular tiles 600. In addition, the end portions 634 may further comprise radial end surfaces designed to facilitate the sliding and lateral deflection of the end portions 634, which radial end surfaces are described above in relation to FIGS. 1-9. Further, the type of synthetic material employed for the modular tiles 600 can also be a factor for the size and configuration of the primary post structures 630 to provide the amount of deflection or impact absorbency desired in the modular tiles 600.

There are many other advantages in addition to those already discussed in providing a modular tile with secondary post structures as taught herein. The secondary post structures and their ability to control the deflection of the primary post structures also functions to provide the modular tile with controlled shock absorption, meaning that the modular tile comprises an increased elastic capacity to "give" when subject to an applied load.

Another advantage is to provide the modular tile with an increase in bounce or spring as compared to prior related modular tiles. By limiting the deflection of the primary post structures under prescribed loads, the primary post structures are able to essentially spring back into their initial position once the load is removed. This also functions to provide greater ball rebound, as well as to assist, to a limited degree, jumping by an individual.

Still another advantage to providing a modular tile with deflecting primary post structures and controlling or limiting their deflection with secondary post structures is that the modular tile comprises an improved surface feel. Due to the controlled deflection, the tile is and feels less rigid. Unlike prior related modular tiles existing in the art, the "give" in the tile results in lower and/or absorbed impact forces, thus reducing injury to individuals using the array of modular tiles.

It is noted and emphasized herein that the features and elements of the different embodiments discussed above are related in that any one or more elements from any one or more embodiments may be incorporated into any other embodiment. As such, the present invention is not limited to the tile embodiments specifically discussed and shown in the drawings.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are expressly recited. Accordingly, the scope of the invention should be determined solely by the appended claims and their legal equivalents, rather than by the descriptions and examples given above.

What is claimed and desired to be secured by Letters Patent is:

1. A tile configured to form a floor covering over a floor, said tile comprising:

a top surface having a periphery defining side walls extending downward from the top surface; and a bottom side substantially perpendicular to the side walls, opposite the top surface; and an array of support structures extending downward from said bottom side, at least some of the support structures comprising deflecting primary support structures that deflect at angle with respect to the bottom when subjected to a threshold load, and at least some of the support structures comprising different height secondary support structures that limit the angular deflection of the deflecting support structures.

2. The tile of claim 1, wherein the deflecting support structures comprise a resilient end portion configured to resiliently deflect against the floor with a load being placed above the support structures to the top surface.

3. The tile of claim 2, wherein the resilient end portion is configured to resiliently deflect against the floor to provide an upward spring force.

4. The tile of claim 2, wherein the resilient end portion is configured to suspend the side walls of the tile above the floor.

5. The tile of claim 2, wherein the resilient end portion deflects in a bi-lateral direction.

6. The tile of claim 2, wherein the resilient end portion in the array of support structures deflects between a first bi-lateral direction and a second bi-lateral direction between respective adjacently positioned support structures.

7. The tile of claim 6, wherein the first bi-lateral direction is transverse to the second bi-lateral direction.

8. The tile of claim 2, wherein the resilient end portion comprises an elongated width to facilitate the resilient end portion to resiliently deflect in a bi-lateral direction.

9. The tile of claim 2, wherein the resilient end portion comprises a tapered end portion configured to resiliently deflect at and angle with respect to an upper portion.

10. The tile of claim 2, wherein the resilient end portion comprises a projection configured to resiliently deflect with a load being placed above the support structures on the top surface.

11. The tile of claim 1, wherein the deflecting support structures comprise a radial end surface configured to induce a resilient end portion to slide and deflect laterally with a load being placed on the top surface.

12. The tile of claim 1, wherein the side walls have a coupling portion configured to couple with other tiles adjacent thereto to form a modular floor covering.

13. The tile of claim 1, wherein the bottom side comprises an interconnected support grid.

14. A modular floor tile system comprising:

a floor tile adapted for placement about a floor, said floor tile comprising:

a top surface configured to receive and distribute a load, and to deflect under said load;

side walls extending downward from said top surface and defining a periphery of said tile;

a bottom side opposite said top surface;

a plurality of load bearing primary post structures extending downward from and arranged about said bottom side, said primary post structures including at least one end portion configured to be in continuous contact with the floor, and to facilitate deflection of said top surface in response to said load, the end portion deflecting at an angle with respect to a top portion of the primary post structure; and a plurality of secondary post structures also extending downward from said bottom side and interspaced with said primary post structures, said secondary post structures having a different height than said primary post structures, and including at least one end portion configured to contact said floor and support said top surface only upon said deflection of said primary post structures, said secondary post structures limiting said deflection of said primary post structures and said top surface.

15. The tile of claim 14, wherein said side walls comprise a coupling portion configured therewith to couple with other tiles adjacent thereto to form a modular floor covering.

16. The tile of claim 14, wherein said secondary post structures are activated and configured to displace to contact said floor upon said load being in excess of a predetermined primary load threshold.

17. The tile of claim 16, wherein said predetermined primary load threshold is between 100 and 300 pounds per square inch.

18. The tile of claim 16, wherein said primary post structures extend from said bottom surface a greater distance than said secondary post structures, wherein an end portion of said secondary post structures is located above said floor at loads below said primary load threshold.

19. The tile of claim 16, wherein the primary support structures and secondary support structures comprise a plurality of posts and wherein each primary post structure is adjacent to at least four secondary post structures.

20. The tile of claim 16, wherein the primary post structure resiliently deflects in a bi-lateral direction with respect to a longitudinal axis of the post structure.

* * * * *